US005494453A

United States Patent [19]

Tsuji et al.

[11] Patent Number: 5,494,453

[45] Date of Patent: Feb. 27, 1996

[54] CONNECTOR HOUSING

[75] Inventors: Masanori Tsuji; Motohisa Kashiyama; Sakai Yagi, all of Shizuoka, Japan

[73] Assignee: Yazaki Corporation, Japan

[21] Appl. No.: 306,586

[22] Filed: Sep. 15, 1994

[30] Foreign Application Priority Data

Sep. 16, 1993 [JP] Japan ..... 5-230015

[51] Int. Cl.[6] ..... H01R 13/64

[52] U.S. Cl. ..... 439/381; 439/135

[58] Field of Search ..... 439/374–378, 439/595, 599, 600, 660, 379–381, 135

[56] References Cited

U.S. PATENT DOCUMENTS

| | | | |
|---|---|---|---|
| 4,752,240 | 6/1988 | Jagen et al. | 439/595 |
| 4,806,123 | 2/1989 | Konishi et al. | 439/595 |
| 4,900,271 | 2/1990 | Colleran et al. | 439/595 |
| 4,940,430 | 7/1990 | Fujitani et al. | 439/352 |
| 5,281,168 | 1/1994 | Krehbiel et al. | 439/595 |

FOREIGN PATENT DOCUMENTS 61-100885 6/1986 Japan .

*Primary Examiner*—David L. Pirlot

*Attorney, Agent, or Firm*—Wigman, Cohen, Leitner & Myers

[57] ABSTRACT

In a first housing accommodating a female terminal, there is provided a front wall defining an insert opening into which a male terminal accommodated in a second housing is inserted. The first housing includes a first slope defining the insert opening for guiding the distal end of the male terminal in the second housing toward a fitting part of the female terminal into which the male terminal is fitted and an inside wall for encompassing the female terminal and for defining an escape room around the female terminal. Also, the first housing includes a second slope in the front wall which extends from the open end of the insert opening toward the escape room for guiding the male terminal in the second housing toward the escape room when the male terminal is deformed and does not enter the insert opening.

5 Claims, 4 Drawing Sheets

CONNECTOR HOUSING

BACKGROUND OF THE INVENTION

The present invention relates to a pair of connector housings which accommodate a male terminal(s) and a female terminal(s), respectively, and more particularly, to a pair of connector housings which can prevent the male terminal(s) from abutting the housing accommodating the female terminal(s) when the pair of connector housings are coupled.

A pair of conventional connector housings are disclosed in the Japanese Utility Model Application Laid Open No. 61-100885. Referring to FIG. 1, the connector housing 1 described in this application includes a chamber or channel 2 for accommodating a female terminal 5. The channel 2 is opened rearward (the right side in FIG. 1). On the other hand, an opening 3 is provided in a front wall 1*a* on the front of the housing 1. The opening 3 communicates with the channel 2. A flexible arm 4 for engaging the female terminal 5 is provided inside the channel 2. That is, a female terminal 5 is inserted and pushed into the channel 2 from the rearward opening until it reaches a predetermined position at which it engages with the flexible arm 4.

The front part of the female terminal 5 has a cylinder-like channel body defined by a bottom section 6, sides 7 extending upward from the bottom 6, and an upper section 8 extending from the sides 7. A tongue extends from the bottom 6 toward the inside rear of the channel body so as to form a U-like shape with the bottom section 6. A male terminal 12 may be fitted between the tongue 9 and the upper section 8 for the electrical connection with the female terminal 5. The rear of the female terminal 5 has a clasp for crimping a wire 10.

Another housing to be coupled with the above-described housing 1 (not illustrated In FIG. 1) also has a flexible arm with the similar form to the arm 4. A male terminal 12 with the wire is inserted inside the another housing and engages with the arm. (Only the distal end of the male terminal 12 is illustrated in FIG. 1.)

When the front end of the housing 1 is inserted into the another housing, the male terminal 12 is inserted into and passes the opening 3 of the housing 1 and is fitted between the tongue 9 and the upper section 8 so that the two terminals 5, 12 are electrically connected.

The female terminal 12 may be deformed before the coupling of the housings and may not enter the opening 3. Concerning the above, slopes 3*a* for guiding the distal end of the male terminal 12 toward the female terminal 5 define the opening 3 so that the radius of the opening 3 gradually increases toward the front end of the housing 1. Therefore, if the deformation of the male terminal 12 is small, the male terminal 12 can enter the opening 3 and can be guided toward the female terminal 5 along the slopes 3*a*. However, there has been concern that the deformation of the male terminal 12 is not small and the distal end of the male terminal 12 abuts the front wall 1*a*, thereby causing damage of a portion of the arm provided in the another housing, which engages the male terminal 12.

As shown in FIG. 2, in the case in which a part of the housing 1 corresponding to the front wall 1*a* shown in FIG. 1 is partly cut off, if the deformation of the male terminal 12 is relatively large, the male terminal 12 may not enter the opening 3 for the regular connection or engagement but may enter another opening, thereby contacting the outer bottom of the tongue 9. Consequently, the male and female terminals 12, 5 can be electrically connected, thereby preventing the discovery of this irregular connecting condition therebetween.

SUMMARY OF THE INVENTION

In view of the above, an object of the present invention is to solve the aforementioned problems in the prior art through the introduction of a pair of connector housings which, while allowing the male terminal with a relatively small deformation to be guided to an opening for engaging the female terminal, can prevent the male terminal with a relatively large deformation from abutting the front wall of the first housing accommodating the female terminal.

Another object of the present invention is to provide a pair of connector housings which can indicate that the female terminal and the male terminal with a relatively large deformation are not regularly connected, or wherein an irregular engagement between the female terminal and the male terminal with a relatively large deformation can be detected.

The afore-mentioned objects of the present invention are accomplished through a pair of connector housings for connecting a male terminal and a female terminal comprising: a first housing accommodating the female terminal therein; a fitting part provided in the female terminal for fitting the male terminal therein; a second housing accommodating the male terminal therein, said second housing coupling the first housing so as to allow the male terminal accommodated in the second housing to be fitted in the fitting part of tile female terminal accommodated in the first housing; a front wall provided in the first housing and facing the second housing, said front wall defining an insert opening into which the male terminal in the second housing is inserted; a first slope defining the insert opening for guiding the distal end of the male terminal in the second housing toward the fitting part of the female terminal; an inside wall provided in the First housing for encompassing the female terminal in the first housing therearound and defining an escape room around the female terminal in the first housing; a second slope provided in the front wall and extending from the open end of the insert opening toward the escape room for guiding the male terminal in the second housing toward the escape room when the male terminal is deformed and does not enter the insert opening.

In the coupling of the first and second housings, if tile deformation of the male terminal is relatively small, the distal end of the male terminal is guided by the first slope and passes the insert opening while being adjusted thereto, thereby being fitted into the female terminal.

If the deformation of the male terminal is relatively large, the distal end of the male terminal may be guided by the second slope toward the escape room around the female terminal, thereby preventing the male terminal from abutting the front wall of the first housing.

The male terminal guided into the escape room may not contact the female terminal and may prevent the regular or normal coupling between the housings, thereby indicating that the male and female terminals are not regularly connected and facilitating correction or exchange the deformed male terminal.

DETAILED DESCRIPTION OF THE PREFERRED EMBODIMENTS

An explanation of an embodiment of the present invention will now be given with reference to FIG. 3 to FIG. 7.

In this embodiment, each female terminal 25 has a conventional shape. Specifically, the front part of each female terminal 25 has a cylinder-like channel body with a tongue inside the body so as to allow a male terminal 12 of a conventional type to be fitted into the body for the electrical connection therebetween. The rear of the female terminal 25 has a clasp for crimping a wire 10.

Figure 1:
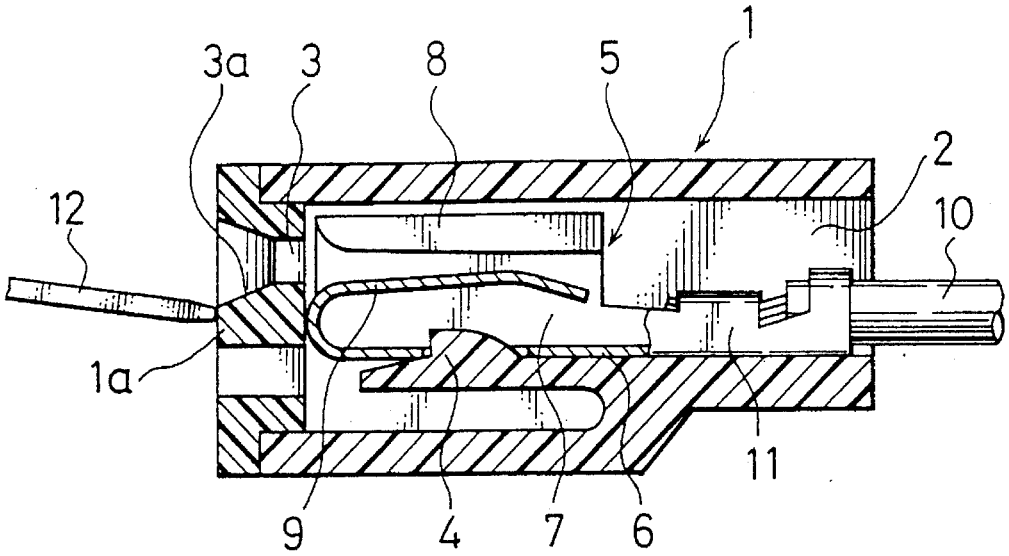
FIG. 1 PRIOR ART
FIG. 1 is a sectional view of a conventional housing.
Figure 2:
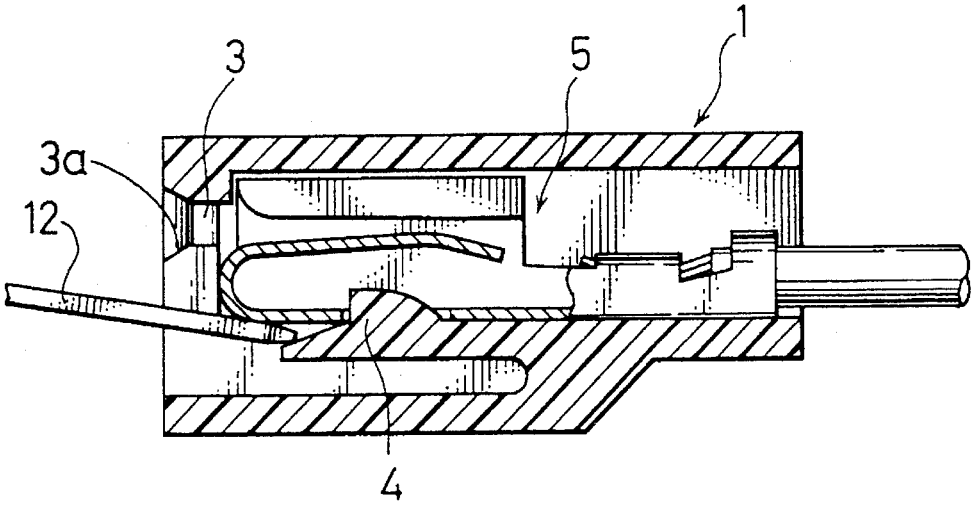
FIG. 2 PRIOR ART
FIG. 2 is a sectional view of a conventional housing.
Figure 3:
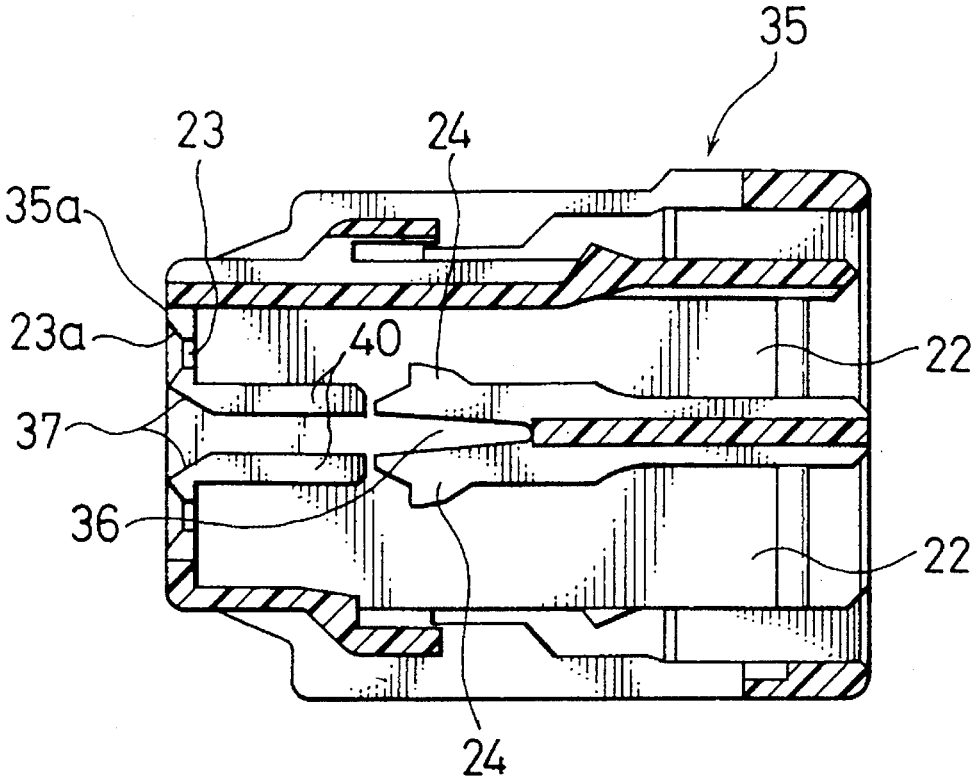
FIG. 3 is a sectional view of a housing according to an embodiment of the present invention.
Figure 4:
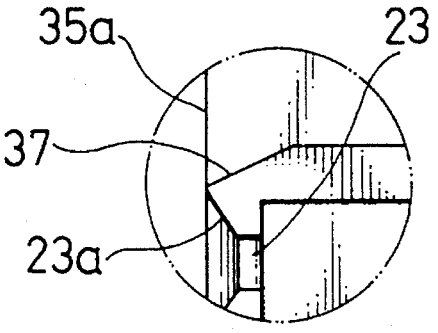
FIG. 4 is an enlarged sectional fragmentary view of the housing illustrated in FIG. 3.
Figure 5:
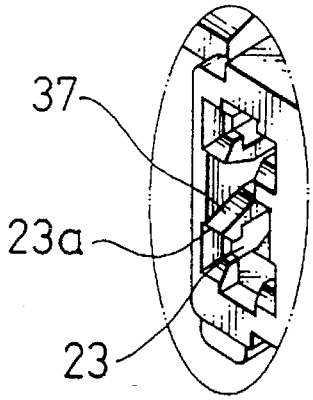
FIG. 5 is an enlarged perspective fragmentary view of the housing illustrated in FIG. 3.
Figure 6:
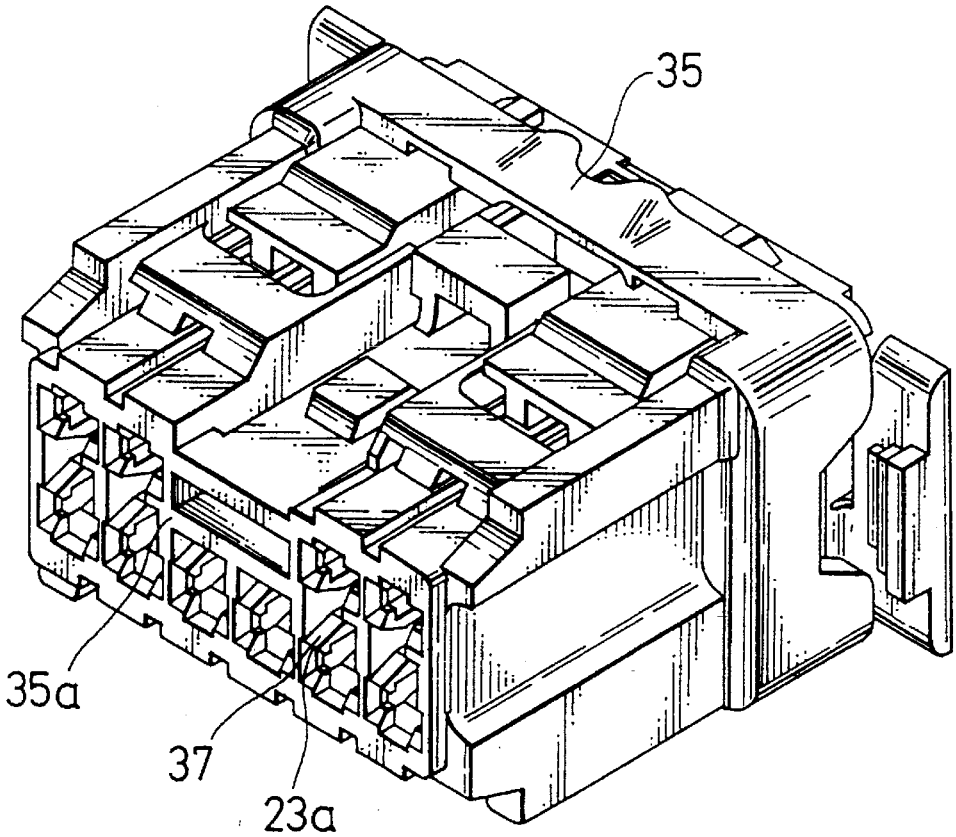
FIG. 6 is a perspective view of the housing illustrated in FIG. 3.
Figure 7:
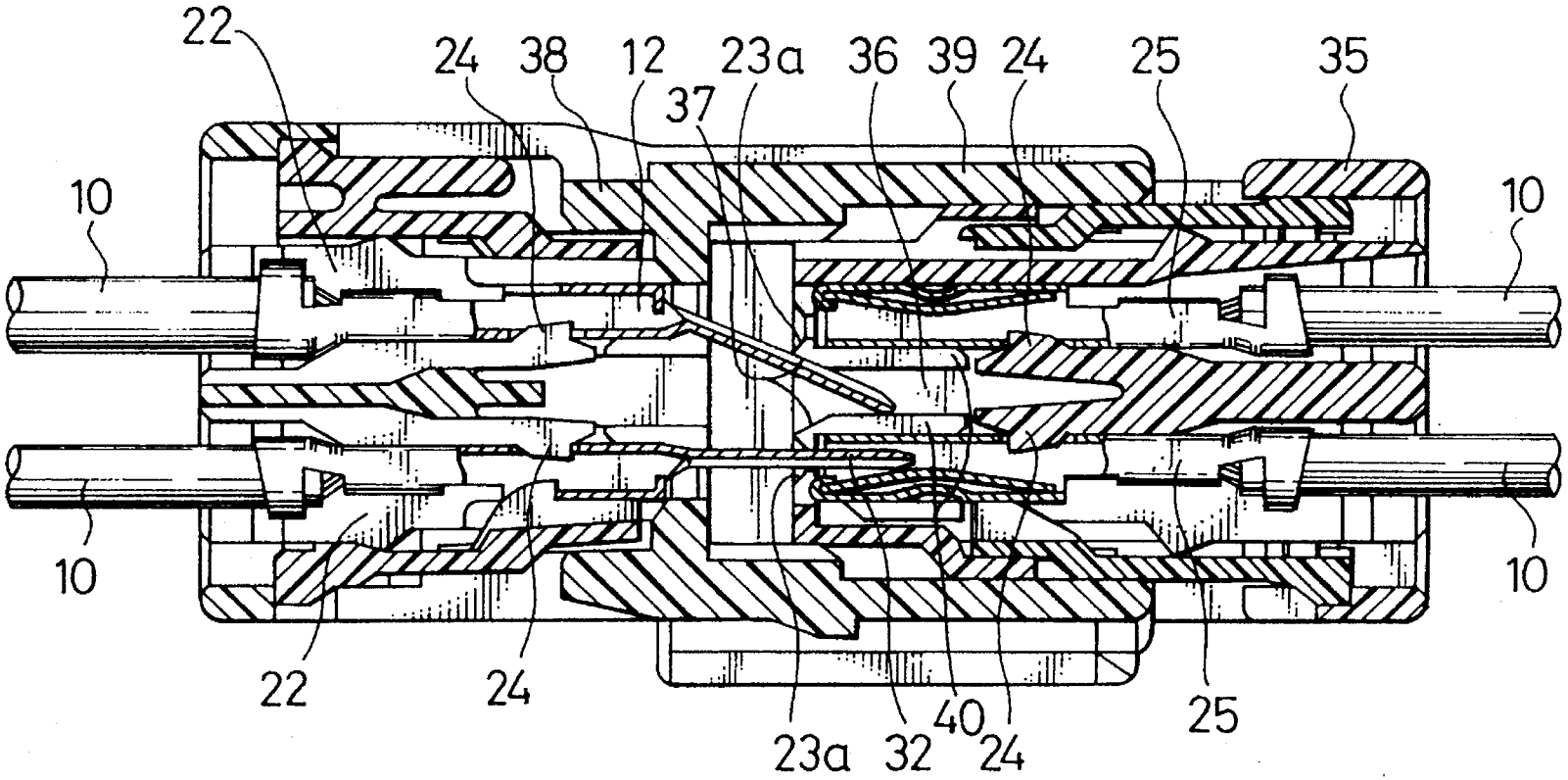
FIG. 7 is a sectional view of a pair of housings one of which is illustrated in FIG. 3.

As shown in FIGS. 3, 6, and 7, a first housing 35 includes a plurality of chambers or channels 22 for accommodating a plurality of female terminals 25 thereinside. Specifically, the first housing 35 is vertically divided into two and has four channels in its upper row and six channels in its bottom row. The channels 22 are opened rearward (the right side in FIGS. 3 and 7). (Hereinafter the left side in FIGS. 3 and 7 of the first housing 35 or the female terminals will be referred to as the front side thereof.)

A plurality of conventional openings 23 are defined in the front end wall 35*a* of the first housing 35 by first slopes 23*a* for guiding the distal ends of the male terminals 12 toward the corresponding female terminals 5 in the first housing 35. That is, the radius of each opening 23 gradually increases toward the front end of the housing 35. The openings 23 respectively communicate with the corresponding channels 22.

The vertically located upper and lower channels 22 have roughly mutually symmetrical forms. Between the upper channel 22 and the lower channel 22 immediately thereunder, there is provided a flexible arm 24 with a pair of engaging portions respectively for engaging a pair of female terminals 25 in the upper and lower channels 22 in the first housing 35. The vertically located pair of engaging portions of the one flexible arm 24 are mutually opposed and spaced apart, thereby defining one room 36.

Each opening 23 has the first slopes 23*a* as described above, and other slopes 37 are formed for guiding the male terminal 12 in the second housing 38 toward the room 36 when the male terminal 12 is deformed and does not enter the corresponding opening 23. That is, the second slope 37 extends from a side of the open end of the opening 23 toward the room 36, thereby forming an acute angle between the first slope 23*a* and the second slope 37. Specifically, if the opening 23 is in the upper row, the second slope 37 extends from the lower side of the first slope 23*a* toward the room 36 located under the opening 23, and vice versa. Since the slopes 23*a*, 37 for one channel 22 form an acute angle or a ridge-like shape in the front end of the housing 35, the male terminal 12 is easily led along either slopes 23*a*, 37. Specifically, when the deformation of the male terminal 12 is not small, the distal end of the male terminal 12 may be led along the second slope 37 toward the room 36.

The first housing 35 is provided with inner walls 40 Formed of an insulating material under the front side of the female terminals 25 of the upper row and/or over the front side of the female terminals 25 of the lower row. Therefore, the vertically located pair of inner walls 40 30 under the upper female terminal 25 and the lower female terminal 25 defines the room 36.

A second housing 38 to be coupled with tile first housing 35 has a number of channels 22 corresponding to that of the first housing 35 and the channels 22 are disposed corresponding to the channel disposition of the first housing 35. The second housing 38 has a cylinder portion 39 in its front side (the right side in FIG. 7) for accepting the front side of the first housing 35 thereinside for coupling.

Now, the proper number of female and male terminals 25, 12 with the wire 10 respectively are inserted into the first and second housings 35, 38 while engaging the engaging portions of tile flexible arms 24.

Next, the effects of the connector housings 35, 38 described above will be explained below with reference to FIG. 7.

When the first housing 35 is inserted into the cylinder portion 39 of tile second housing 38, if the deformations of the male terminals 12 are small, while the distal ends of the male terminals 12 are guided by the first slopes 23*a* of the openings 23, the male terminals 12 are fitted into the corresponding female terminals 25 as shown by the bottom side male terminal 12 in FIG. 7. Then, when the first housing 35 is completely coupled with the second housing 38, the male and female terminals 12, 35 are in their regular connecting states.

However, if the deformation of one of the male terminals 12 is accidentally large, when the first housing 35 is inserted into the cylinder portion 39 of the second housing 38, while the distal end of the male terminal 12 is guided by the corresponding second slope 37 without abutting the front wall 35*a*, the male terminal 12 is inserted into the corresponding room 36 as shown by the upper side male terminal 12 in FIG. 7. Accordingly, the first housing 35 may not completely inserted and coupled with the second housing 38, thereby indicating that there is incomplete coupling between the housings. Further, even if the incomplete coupling between the housings cannot be noticed, a test for examining whether each male terminal 12 is electrically connected with the corresponding female terminal 35 indicates that there is incomplete coupling due to the existence of the inside wall 40 of the insulating material. In that situation, the operator can exchange the male terminal with a large deformation for one with a small deformation and can make a complete coupling between the housings.

Furthermore, the possibility that the distal end of the male terminal 12 abuts the front end 35*a* of the first housing 35 is reduced by both slopes 23*a*, 37 forming an acute angle, thereby reducing the damage to the engaging portion of the arm 24 provided in the second housing for engaging with the male terminal 12.

What is claimed is:

1. A pair of connector housings for connecting a male terminal and a female terminal comprising:

a first housing accommodating the female terminal therein;

a fitting part provided in the female terminal for fitting the male terminal therein;

a second housing accommodating the male terminal therein, said second housing coupling the first housing so as to allow the male terminal accommodated in the second housing to be fitted in tile fitting part of the female terminal accommodated in the first housing;

a front wall provided in the first housing and facing the second housing, said front wall defining an insert opening into which the male terminal in the second housing is inserted;

a first slope defining the insert opening for guiding the distal end of the male terminal in the second housing toward the fitting part of the female terminal;

an inside wall provided in the first housing for encompassing the female terminal in the first housing therearound and defining an escape room around the female terminal in the first housing;

a second slope provided in the front wall and extending from the open end of the insert opening toward the escape room for guiding the male terminal in the second housing toward the escape room when the male terminal is deformed and does not enter the insert opening.

2. A pair of connector housing according to claim 1, wherein the second slope extends from a first side of the open end of the insert opening and the inside wall defines the escape room in the first side of the insert opening, thereby forming an acute angle between the first and second slopes.

3. A pair of connector housing according to claim 1, wherein the inside wall extends from the front wall forming the second slope toward the escape room and is formed of an insulating material to insulate the male terminal entered the escape room from the female terminal in the first housing.

4. A pair of connector housing according to claim 1, wherein the first and second housings respectively include a pair of female and male terminals, and wherein the first housing includes a pair of second slopes mutually opposed and spaced apart, thereby defining one escape room.

5. A pair of connector housing according to claim 4, further comprising a flexible arm with a pair of engaging portions respectively for engaging a pair of female terminals in the first housing, said pair of engaging portions being mutually opposed and spaced apart, thereby defining one escape room.

* * * * *